US009337561B2

(12) United States Patent
Panitz et al.

(10) Patent No.: US 9,337,561 B2
(45) Date of Patent: May 10, 2016

(54) CONTACT ELEMENT FOR A PLUG TYPE CONNECTOR AND ARRANGEMENT COMPRISING A CONTACT ELEMENT

(71) Applicant: Tyco Electronics AMP GmbH, Bensheim (DE)

(72) Inventors: Gregor Panitz, Soergenloch (DE); Christian Schellhaas, Zwingenberg (DE); Volker Seipel, Bensheim (DE); Dirk Duenkel, Bensheim (DE); Michael Schall, Heppensheim/Sonderbach (DE)

(73) Assignee: TE Connectivity Germany GmbH, Bensheim (DE)

( * ) Notice: Subject to any disclaimer, the term of this patent is extended or adjusted under 35 U.S.C. 154(b) by 9 days.

(21) Appl. No.: 14/528,589

(22) Filed: Oct. 30, 2014

(65) Prior Publication Data

US 2015/0118920 A1 Apr. 30, 2015

(30) Foreign Application Priority Data

Oct. 30, 2013 (DE) ..... 10 2013 222 143

(51) Int. Cl.

| | |
|---|---|
| ***H01R 13/40*** | (2006.01) |
| ***H01R 13/02*** | (2006.01) |
| ***H01R 12/89*** | (2011.01) |
| ***H01R 13/42*** | (2006.01) |
| *H01R 12/72* | (2011.01) |
| *H01R 12/75* | (2011.01) |
| *H01R 13/24* | (2006.01) |

(52) U.S. Cl.

CPC ..... *H01R 13/02* (2013.01); *H01R 12/89* (2013.01); *H01R 13/42* (2013.01); *H01R 12/721* (2013.01); *H01R 12/75* (2013.01); *H01R 13/2442* (2013.01)

(58) Field of Classification Search

CPC .... H01R 13/02; H01R 13/42; H01R 13/2442; H01R 12/721; H01R 12/75; H01R 12/89

USPC ..... 439/595, 637, 744, 862

See application file for complete search history.

(56) References Cited

U.S. PATENT DOCUMENTS

| | | | | |
|---|---|---|---|---|
| 5,746,628 | A * | 5/1998 | Yamamoto | H01R 13/4362 439/595 |
| 7,572,142 | B2 * | 8/2009 | Katsuma | H01R 13/4367 439/352 |
| 7,828,581 | B2 * | 11/2010 | Okayasu | H01R 13/4362 439/352 |
| 8,895,876 | B2 * | 11/2014 | Makino | H01R 9/223 174/520 |
| 9,112,305 | B2 * | 8/2015 | Sato | H01R 13/5219 |

* cited by examiner

*Primary Examiner* — Khiem Nguyen
(74) *Attorney, Agent, or Firm* — Barley Snyder

(57) ABSTRACT

A contact element for a plug type connector is provided a contact body having a pair of guiding faces and a catch opening. The contact body is prepared from electrically conductive contact material. The pair of guiding faces provide a reinforced region with each guiding face having a plurality of layers overlapping each other transversely with respect to a length of contact body. The catch opening is disposed between the pair of guiding faces.

16 Claims, 4 Drawing Sheets

CONTACT ELEMENT FOR A PLUG TYPE CONNECTOR AND ARRANGEMENT COMPRISING A CONTACT ELEMENT

CROSS-REFERENCE TO RELATED APPLICATIONS

This application claims the benefit of the filing date under 35 U.S.C. § 119(a)-(d) of German Patent Application No. 10 2013 222 143.6, filed Oct. 30, 2013.

FIELD OF THE INVENTION

The invention relates to a contact element and, more particularly, to contact element for a plug type connector.

BACKGROUND

Contact elements are often used in housings and retained by them. In order to retain a contact element in a housing of a plug type connector in a secure manner, for instance, positive-locking connections are used, with either a portion of a housing protruding into an opening of the contact element or a portion of the contact element protruding into an opening in the housing of the plug type connector. Since contact elements are often manufactured with thin-walled material, for example, using bending/punching technologies, the materials generally have a low resisting force with respect to undesirable release of the contact element from the housing. Often the contact elements or the housing become damaged when the contact element is inserted or released. A further problem with these known contact elements is that, when they are used in plug type connectors have sealing elements, the insertion or removal of the contact element in/from the plug type connector through the sealing element leads to damage of the sealing element. Accordingly, maintenance or replacement of the contact element results in increased use of material and cost.

SUMMARY

In view of the above described problems, an object of the invention, among others, is to provide a contact element for a plug type connector is provided a contact body having a pair of guiding faces and a catch opening. The contact body is prepared from electrically conductive contact material. The pair of guiding faces provide a reinforced region with each guiding face having a plurality of layers overlapping each other transversely with respect to a length of contact body. The catch opening is disposed between the pair of guiding faces.

BRIEF DESCRIPTION OF THE DRAWINGS

The invention will now be described by way of example, with reference to the accompanying Figures, of which.

DETAILED DESCRIPTION OF THE EMBODIMENT(S)

The structure of a contact element according to the invention is first described with reference to FIGS. 1 to 4.

Figure 5:
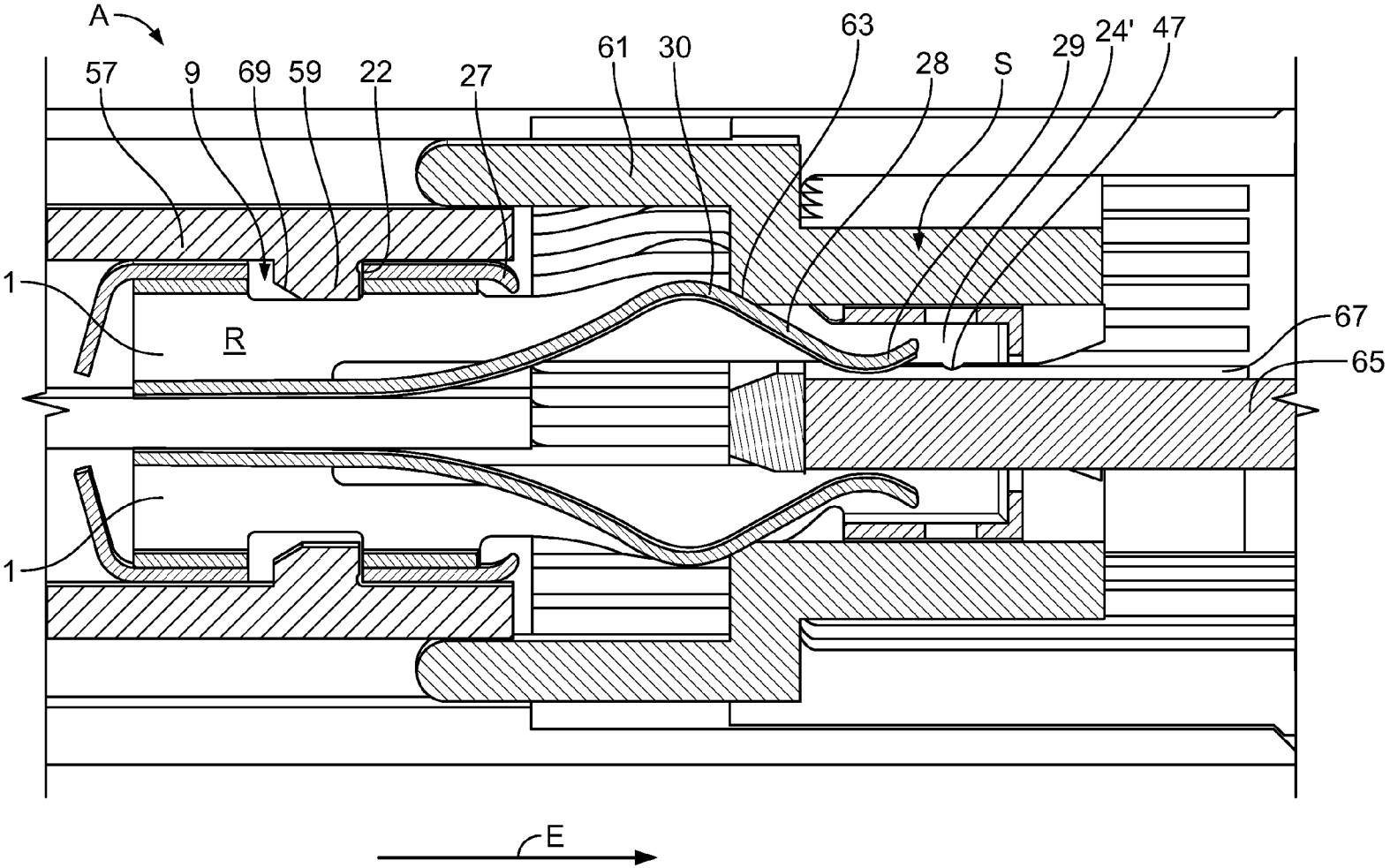
FIG. 5 is a sectional view of a contact element according to the invention in an arrangement with a housing.

The function of the contact element according to the invention is described in conjunction with an arrangement according to the invention as shown in FIG. 5.

As shown, a contact element 1 according to the invention is shown and formed by an electrically conductive contact material 3 that is a monolithic component having been bent and/or punched. The body 5 of the contact element 1 extends along an insertion direction E. The contact element 1 has a tip region S with a tip 26 at one end thereof and includes and a crimp portion C disposed at opposite end thereof.

The body 5 includes a catch opening 9 along an upper side 7 thereof. The catch opening 9 formed by guiding faces 21, 21'. The guiding faces 21, 21' extend from ends 56, 56' thereof to the catch opening 9 in a continuous and bend-free manner. The guiding faces 21, 21' include catch edges which extend transversely relative to the insertion direction E. The guiding faces 21, 21' are formed by the reinforced regions Va, Vb. The reinforced regions Va, Vb each have two overlapping layers 23*a* and 23*a*' in the reinforced region Va and overlapping layers 23*b* and 23*b*' in the reinforced region Vb.

The body 5 also includes side walls 24 and 24'. The layers 23*a* and 23*b* extend from the side wall 24 towards the opposing side wall 24. Additionally, the layers 23*a*' and 23*b*' extend from the side wall 24 in the direction towards the side wall 24'. The two overlapping layers 23*a*, 23*a*' and 23*b*, 23*b*' abut each other and extend parallel with the upper side 7 of the contact element 1. The reinforced regions Va, Vb bridge the side walls 24 and 24'.

The body 5 has a substantially box-like profile in the shown embodiment along the catch opening 9 and the reinforced regions Va and Vb. The guiding faces 21, 21' are formed by the surfaces 25, 25' of the layers 23*a*' and 23*b*' of the reinforced regions Va and Vb.

The layers 23*a*' and 23*b*' which form the guiding faces 21, 21' are inclined at the ends thereof and directed away from the catch opening 9 in the direction towards the inner side I of the body 5. The inclined leading members 27, 27' are thereby formed from the contact material 3.

In the embodiment shown, the layer 23*b* extends towards the opposing inner wall 35, and a reinforcement lip 33 is formed. The reinforcement lip 33 is located between the reinforcement region Vb and the crimp region C, between the side walls 24 and 24'. The reinforcement lip 33 supports the side walls 24 and 24' with respect to each other. This is particularly advantageous when the contact material 3 in the crimp region C is shaped in order to connect the contact element 1 to an electrical conductor. The reinforcement lip 33 is described in detail with reference to FIG. 4.

The contact element 1 includes a resilient contact arm 28 around the tip region S. The contact arm 28 can be resiliently redirected away from the upper side 7, that is to say, in a downward direction and can be used to contact a printed circuit board. The contact arm 28 includes a contact zone 29 which is directed in the insertion direction E for electrical connection to a printed circuit board and an activation region 30 which is directed upwards in a convex manner. The contact zone 29 is located in a contact portion 53 of the contact element 1. In order to protect the contact arm 28 when the contact element 1 is introduced into a housing or through a seal of a plug type connector, the side walls 24, 24' are bent towards each other in an upper protection portion 30 that is parallel with the insertion direction E and engage with each other through an undercut arrangement. The upper protection portion 30 is arranged above the contact arm 28. Along the tip 26, the side walls 24, 24' are bent towards each other transversely relative to the insertion direction E so that the tip 26 is rounded and a shield 52 is formed which is directed in the insertion direction E.

In the tip region S, there are arranged two fixing pieces 47 which extend from the side walls 24, 24' away from the contact element 1. The fixing pieces 47 may be constructed in a pointed or slightly rounded manner. The fixing pieces 47 extend opposite the upper protection portion 30. In the insertion direction E, the fixing pieces 47 are arranged between the tip 26 and the contact arm 28.

Figure 3:
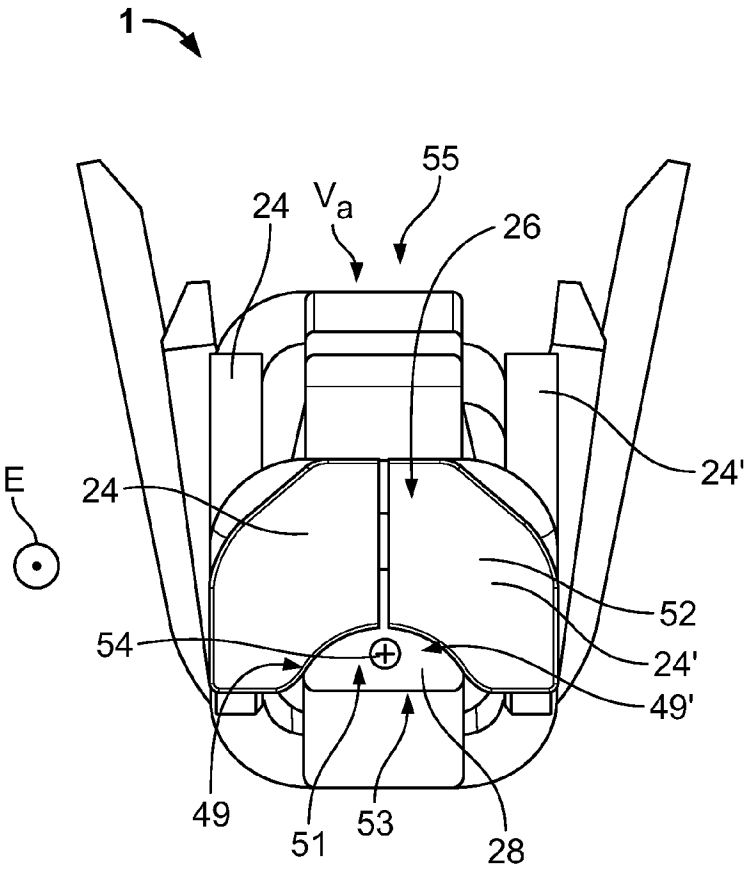
FIG. 3 is a front view of a contact element according to the invention.

FIG. 3 is a front view counter to the insertion direction E of a contact element 1 according to the invention. At the tip 26, the side walls 24 and 24' are bent towards each other transversely relative to the insertion direction E so that the contact element 1 is partially closed in the insertion direction E. The contact arm 28, if present, is thereby protected when the contact element 1 is inserted into a plug type connector. The bent side walls 24, 24' in the region of the tip 26 have recesses 49, 49' which together form the viewing aperture 51. Through the viewing aperture 51 an unrestricted viewing axis 54 extends from the viewing aperture 51 to a contact portion 53. In the contact portion 53, there is arranged the contact zone 29 of the contact arm 28 whose position, in particular relative to the reinforcement region Va, can be verified through the viewing aperture 51.

The reinforcement region Va provides a first prevention region 55. In a cross-section transverse relative to the insertion direction E, the contact element 1 in the reinforcement region Va does not have any axis of symmetry. The reinforcement region Va is thereby a prevention region 55. The prevention region 55 is formed by the fact that the layer 23*a*' which extends from the side wall 24 in the direction towards the side wall 24' is not constructed continuously to the opposing side wall 24'.

Figure 4:
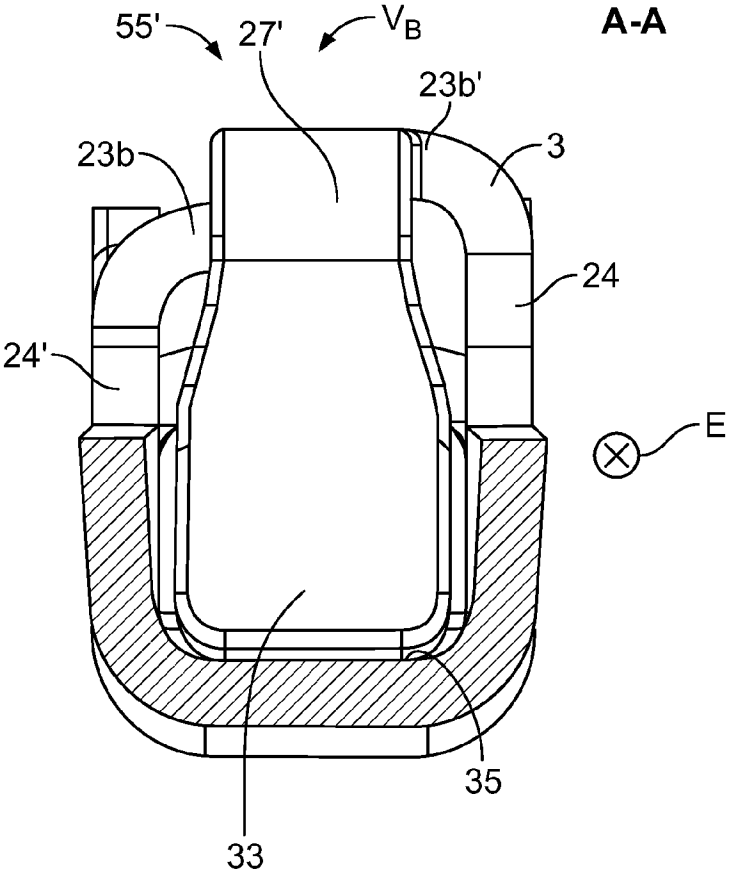
FIG. 4 is a sectional view of a contact element shown in FIG. 3.

As shown in FIG. 4, the reinforcement region Vb forms a second prevention region 55'. The prevention region 55', in the same manner as the prevention region 55, is formed by the layer 23*b*' not extending continuously as far as the opposing side wall 24'. Owing to this asymmetrical cross-section, the contact element 1 can be inserted into a complementary opening in a plug type connector only in one direction. However, introduction into the complementary opening in the opposite direction is not possible.

The reinforcement lip 33 extends from the layer 23*b*' in the reinforcement region Vb and counter to the insertion direction E. The reinforcement lip 33 is arranged between the side walls 24, 24' and is directed in the direction of the opposing inner wall 35. The reinforcement lip 33 is formed by bending contact material 3 from the layer 23*b*'. The inclined leading member 27' is formed by bending the contact material 3. In cross-section transverse relative to the insertion direction E, the reinforcement lip 33 is narrower at the end thereof facing the inclined leading member than in the region between the side walls 24, 24'. The upper narrow region allows bending of the contact material 3 in order to form the inclined leading member 27' and to better position the reinforcement lip 33. The expansion of the reinforcement lip 33 in the region between the side walls 24, 24' adapts to the dimensions of the contact element 1 so that the reinforcement lip 33 is in abutment with the side walls 24, 24' and can support them against each other. The reinforcement lip 33 merges into the inclined leading member 27' so that both form a continuous region. As an alternative to the above-described configuration of the reinforcement lip 33, it may also be directed in the direction towards the crimp region C and be angled only slightly with respect to the guiding face 21'. The sliding along of a seal can thereby be improved.

Now with reference to FIG. 5, an arrangement A according to the invention for electrically contacting with two contact elements 1 according to the invention is shown. The arrangement A may have a large number of contact elements 1. The function of the contact element 1 according to the invention is described with reference to a contact element 1 since the contact elements 1 in the arrangement A shown in FIG. 5 operate in a synchronous manner relative to each other. The contact element 1 is secured in the catch position R in a housing 57 of a plug type connector (not shown). The housing 57 includes a catch projection 59 which protrudes into the catch opening 9. The catch projection 59 and catch opening 9 form the positive-locking connection 60. As an alternative, the contact element 1 may have a position securing element (not shown) which can be resiliently redirected into the body 5 of the contact element 1 and which, in a position in which the contact element 1 is fixed in the housing 57, protrudes from the catch opening 9 and into an opening (not shown) of the housing. A positive-locking connection is thereby formed between the contact element 1 and housing 57 and the contact element 1 can no longer be removed from the housing 57 as long as a maximum permissible force is not exceeded.

The arrangement A has a counter-element 61. The counter-element 61 can be moved in the insertion direction E. If the counter-element 61 is moved counter to the insertion direction E, an actuation portion 63 applies a force to the activation region 30 of the contact arm 28, whereby it is redirected transversely to the insertion direction E. The arrangement A further includes a printed circuit board 65. If the contact arm 28 is redirected transversely relative to the insertion direction E away from the actuation portion 63, the contact zone 29 is placed on the printed circuit board 65 and can produce an electrical connection with respect to a conductor strip 67 of the printed circuit board 65.

In a contact position (not shown), in which the contact arm 28 is placed with the contact zone 29 thereof on a conductor strip 67 and an electrical connection is thereby produced between the contact element 1 and the conductor strip 67, the counter-element 61 may also apply a pressure to the side walls 24, 24' of the contact element 1 so that the contact element 1 at least with the tip region S thereof is redirected or bent in the direction towards the printed circuit board 65. In this instance, the fixing pieces 47 are embedded slightly in the printed circuit board 65 so that the contact element 1 can no longer be displaced with respect to the printed circuit board 65. This is particularly advantageous when the arrangement A is shaken by vibrations or when the printed circuit board 65 or the contact element 1 becomes deformed as a result of thermal changes and the contact element 1 thereby slides on the printed circuit board 65.

Ideally, the fixing pieces 47 are embedded in the printed circuit board 65 beside the conductor strip 67 which makes contact with the contact arm 28. However, at least one fixing piece 47 can in this instance also be at least partially introduced into a conductor strip 67. In addition to the electrical connection between the contact arm 28 and conductor strip 67, an electrical contact is thereby produced by the fixing piece 47 with respect to the conductor strip 67. The arrangement is preferably configured in such a manner that displacement of the printed circuit board 65 counter to the insertion direction E leads to a displacement of the counter-element 61 counter to the insertion direction E. The contact arm is thereby redirected in the direction towards the printed circuit board 65 and the conductor strip 67 is contacted. In order to release the connection, the counter-element 61 may be displaced together with the printed circuit board 65 in the insertion direction E again, whereby the fixing pieces 47 are raised from the printed circuit board 65 and the contact arms 28 are redirected back into the body 5 of the contact element 1 again.

When the contact element 1 is inserted into the housing 57, the inclined leading member 27 slides past an inclined introduction member 69 of the catch projection 59 so that an insertion of the contact element 1 into the housing 57 is possible without damaging the contact element 1 or the catch projection 59. In the catch position shown in FIG. 5, the catch projection 59 protrudes into the catch opening 9 of the contact element 1. The contact element 1 can be displaced counter to the insertion direction E only until the catch edge 22 is in abutment with the catch projection 59 of the housing 57. Another displacement of the contact element 1 counter to the insertion direction E is thereby effectively prevented.

Figure 6:
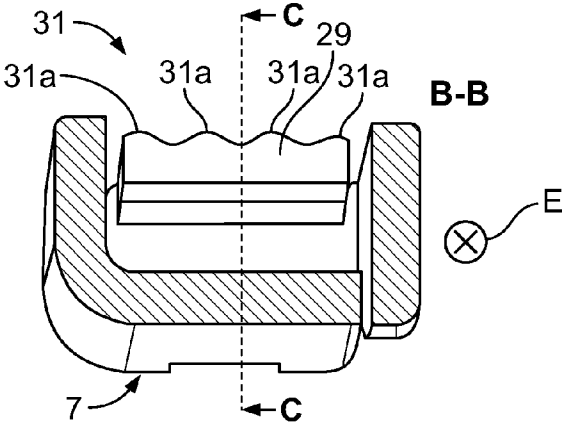
FIG. 6 is a sectional view of a contact zone of a contact element according to the invention.
Figure 7:
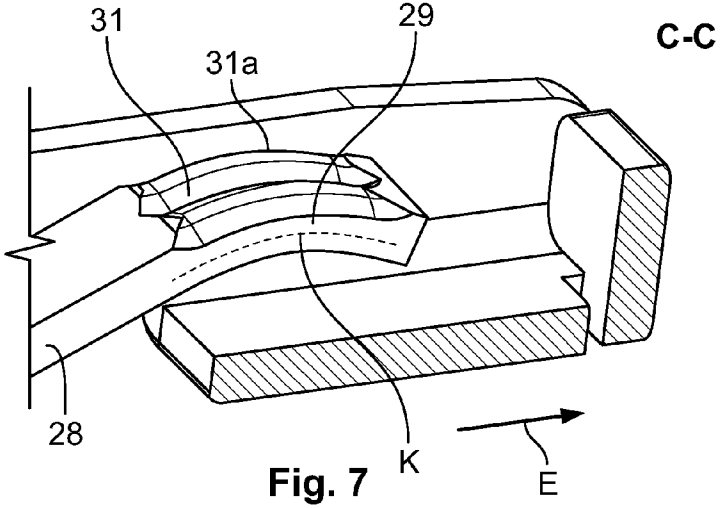
FIG. 7 is another sectional view of the contact zone shown in FIG. 6.

Now with reference to FIG. 6 a contact zone 29 is shown. The contact zone 29 has a rib 31 which is directed downwards, that is to say, away from the upper side 7. The individual ribs 31*a* may in this instance be stamped so as to be, in cross-section, round, rectangular, triangular or in any other suitable shape. The ribs 31*a* form projections which are directed away from the contact element 1. The rib 31 extends substantially in the insertion direction E and in this instance follows a curvature K of the contact zone 29. Owing to the rib 31, the sliding of the contact zone 29 on a printed circuit board when the contact arm 28 is positioned can be improved so that the danger of damage to the printed circuit board or the contact arm 28 can be reduced. The electrical contacting of the contact arm 28 with respect to a printed circuit board can also be improved since the ribs 31 can become embedded slightly in the conductive coating of the printed circuit board. Owing to the fact that a plurality of ribs 31 are provided, it is ensured that at least one rib 31 constantly produces a good electrical contact. One skilled in the art should appreciate that differently constructed projections can also be used in place of a rib.

Figure 1:
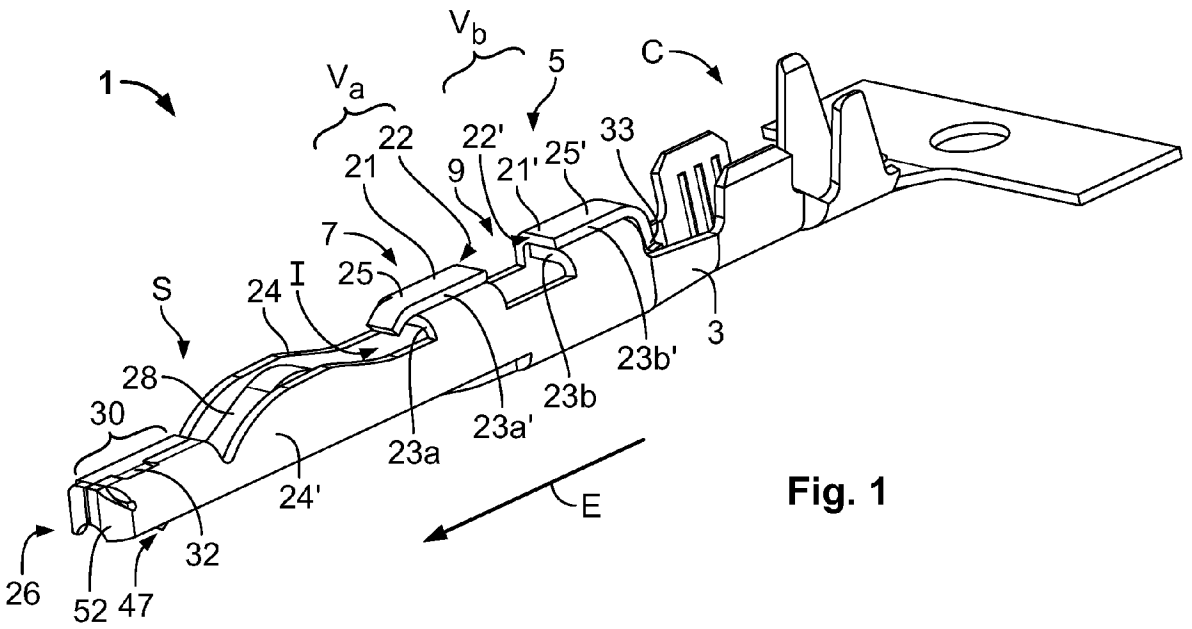
FIG. 1 is a perspective view of a contact element according to the invention.
Figure 2:
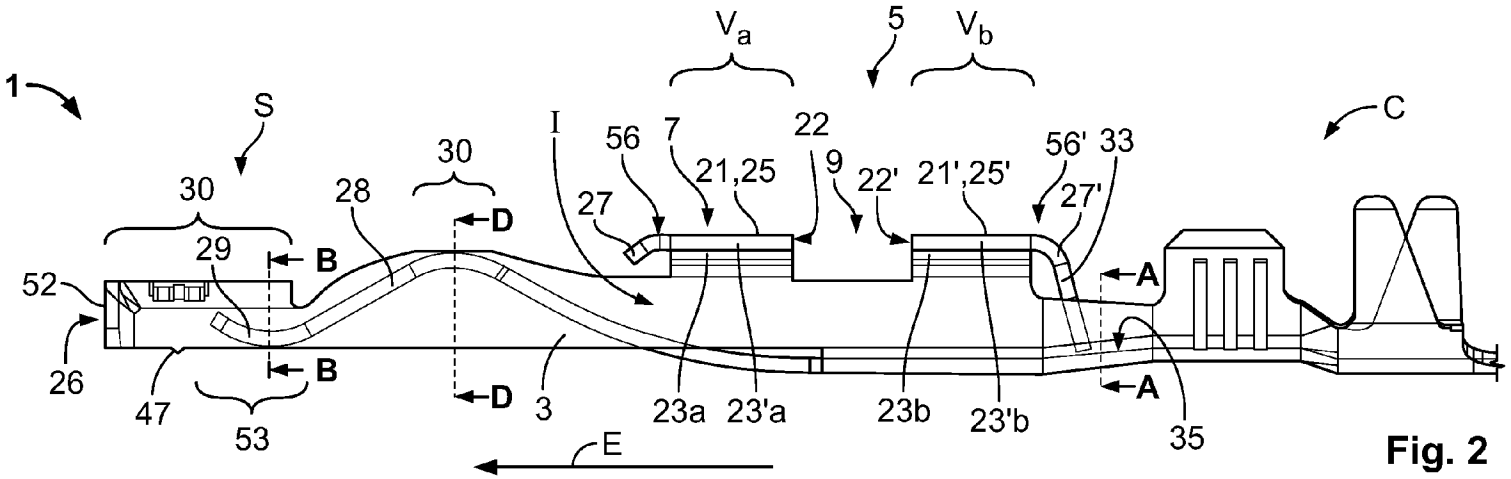
FIG. 2 is a sectioned view the contact element shown in FIG. 1.
Figure 8:
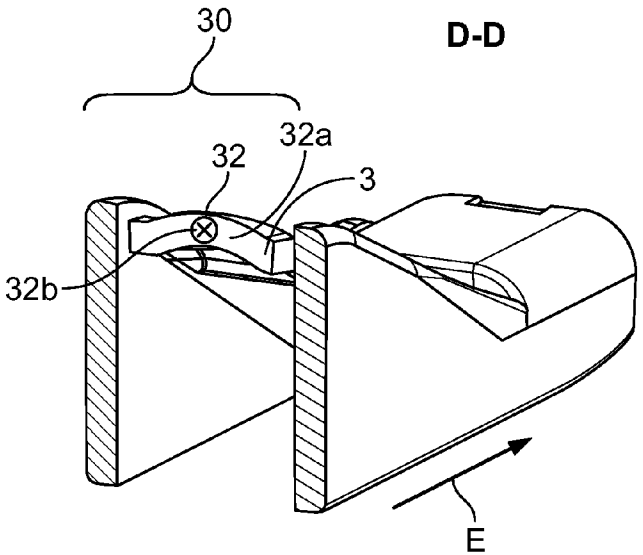
FIG. 8 is a sectional view of an activation region of a contact element according to the invention.

Now with respect to FIG. 8, an activation region 30 according to the invention is shown (see the plane of section D-D shown in FIG. 2). The activation region 30 has a reinforcement structure 32. The reinforcement structure 32 may be formed by bending or stamping the contact material 3 in the activation region 30. The reinforcement structure 32 may be constructed as a bead 32*a*. The longitudinal direction 32*b* of the bead 32*a* extends substantially in the insertion direction E and follows the path of the convex activation region 30.

The reinforcement structure 32 reinforces the contact arm 28 along the activation region 30. On the one hand, the risk of plastic deformation of the activation region 30 when the contact arm 28 contacts a printed circuit board is thereby reduced, so that the contact element 1 can be used or contacted several times. On the other hand, the reinforcement structure 32 reduces the resilient deformation of the activation region 30 during contacting of the contact arm 28 with respect to a printed circuit board. A force which is applied to the activation region 30 is thereby directed in an efficient manner to the contact zone 29, whereby the contact arm 28 is positioned with the contact zone 29 thereof in a particularly secure manner on a printed circuit board.

Although the preferred embodiments of the invention have been described for illustrative purposes, those skilled in the art will appreciate that various modifications, additions, and substitutions are possible, without departing from the scope and sprit of the invention as described in the accompanying claims

What is claimed is:

1. A contact element for an electrical connector, comprising:

a conductive contact body having:

a pair of guiding faces defining a reinforced region, each guiding face of the pair of guiding faces having a plurality of layers overlapping each other transversely with respect to a length of contact body; and a catch opening disposed between the pair of guiding faces.

2. The contact element according to claim 1, wherein each guiding face includes a continuous and bend-free surface along a length thereof.

3. The contact element according to claim 1, further comprising a leading member extending from one of the pair of guiding faces and inclined away from the catch opening.

4. The contact element according to claim 3, wherein the leading member is formed from one of the plurality of layers.

5. The contact element according to claim 1, further comprising a viewing aperture disposed along a tip of the contact body.

6. The contact element according to claim 1, further comprising a reinforcement lip extending from one of the plurality of layers and extending towards an opposing inner wall opposite the pair of guiding faces.

7. The contact element according to claim 6, wherein the reinforcement lip is positioned between the reinforced region and a crimp region and a pair of side walls.

8. The contact element according to claim 1, wherein the reinforced region has an asymmetrical cross-section relative to the length of the contact body.

9. The contact element according to claim 8, wherein an upper layer of the plurality of layers does not extend continuously between opposing side walls of the contact body.

10. The contact element according to claim 1, further comprising a fixing piece disposed along a lower surface of the contact body and extending away therefrom.

11. The contact element according to claim 10, wherein the fixing piece is disposed at a tip of the contact body and the catch opening.

12. The contact element according to claim 11, wherein the fixing piece extends from one of a pair of opposing side walls.

13. The contact element according to claim 1, wherein the contact body is a monolithic component.

14. The contact element according to claim 1, further comprising a resilient contact arm directed transverse to the length of the contact body.

15. The contact element according to claim 14, wherein the resilient contact arm includes a convex activation region extending from a lower surface of the contact body.

16. The contact element according to claim 15, wherein the resilient contact arm further includes a contact zone extending from the activation region and having a concave shape with respect to the activation region.

* * * * *